US005613603A

United States Patent [19]

Joh

[11] Patent Number: 5,613,603

[45] **Date of Patent: *Mar. 25, 1997**

[54] GOLF CLUB DIVIDER ASSEMBLY FOR USE WITH A GOLF BAG

[76] Inventor: William K. Joh, 6852 Vachon Dr., Bloomfield Hills, Mich. 48301

[ * ] Notice: The portion of the term of this patent subsequent to Mar. 27, 2016, has been disclaimed.

[21] Appl. No.: 585,400

[22] Filed: Jan. 11, 1996

Related U.S. Application Data

[63] Continuation-in-part of Ser. No. 410,913, Mar. 27, 1995, Pat. No. 5,505,300.

[51] Int. Cl.[6] ..... A63B 55/00

[52] U.S. Cl. ..... 206/315.6; 206/315.3

[58] Field of Search ..... 206/315.2–315.8; 280/DIG. 6

[56] References Cited

U.S. PATENT DOCUMENTS

| | | | |
|---|---|---|---|
| 1,227,657 | 5/1917 | Pierce | 206/315.6 |
| 1,417,380 | 5/1922 | Hatch | 206/315.6 |
| 1,696,062 | 12/1928 | Thurlow et al. | 206/315.7 X |
| 1,840,183 | 1/1932 | Blitch | 206/315.6 |
| 2,367,234 | 1/1945 | Mitchell | 206/315.2 |
| 2,752,973 | 7/1956 | Stamp | 206/315.6 |
| 3,053,298 | 9/1962 | Stamp | 206/315.6 X |
| 3,967,667 | 7/1976 | Robinson | 206/315.6 |
| 4,111,248 | 9/1978 | Leichhardt | 206/315.6 |
| 4,311,178 | 1/1982 | Kennedy | 206/315.6 |
| 4,673,082 | 6/1987 | Hemme | 206/315.6 |
| 4,703,851 | 11/1987 | Stewert | 206/315.6 |
| 4,753,344 | 6/1988 | Antonious | 206/315.6 X |
| 4,753,446 | 6/1988 | Mills | 206/315.6 X |
| 4,852,896 | 8/1989 | Mills | 206/315.2 X |
| 5,130,974 | 4/1992 | Antonious | 206/315.6 |
| 5,279,414 | 1/1994 | Brasher | 206/315.6 |
| 5,447,228 | 9/1995 | Hodgson | 206/315.3 |
| 5,465,840 | 11/1995 | Joh | 206/315.6 |
| 5,505,300 | 4/1996 | Joh | 206/315.6 |

FOREIGN PATENT DOCUMENTS

| | | | |
|---|---|---|---|
| 349310 | 5/1931 | United Kingdom | 206/315.5 |
| 2130102 | 5/1984 | United Kingdom | 206/315.6 |

*Primary Examiner*—Sue A. Weaver

*Attorney, Agent, or Firm*—Gifford, Krass, Groh, Sprinkle, Patmore, Anderson & Citkowski, P.C.

[57] ABSTRACT

A golf club divider assembly is for use with a golf bag for efficiently and conveniently housing a plurality of golf clubs within a conventional golf bag enclosure in a restraining and shielding fashion. A plurality of sleeve shaped members are inserted axially within the golf bag enclosure. A like plurality of divider members are slidably engaged within the sleeve shaped members and include radially projecting and axially extending vane portions which, upon insertion within the sleeve shaped members, creates pluralities of club shaft receiving cavities. Shielding portions are attached to upper ends of the divider members for encircling and protecting the exposed heads of the golf clubs and for preventing contact between adjacent club heads.

17 Claims, 2 Drawing Sheets

Fig - 1
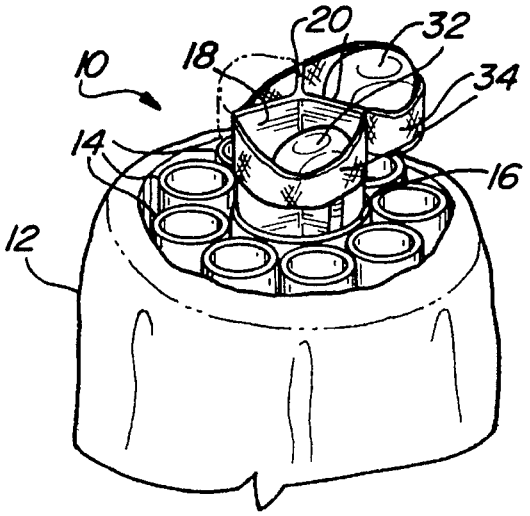
Fig - 2
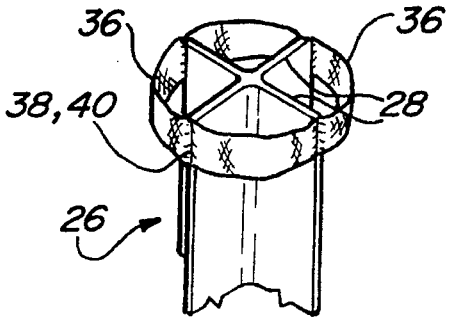
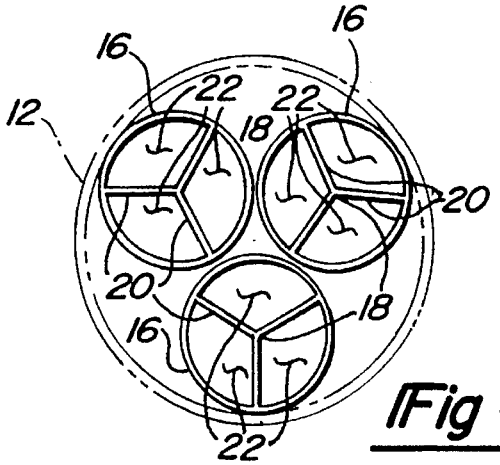
Fig - 3
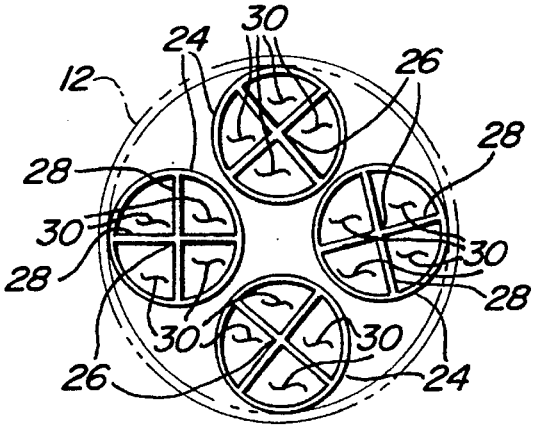
Fig - 4
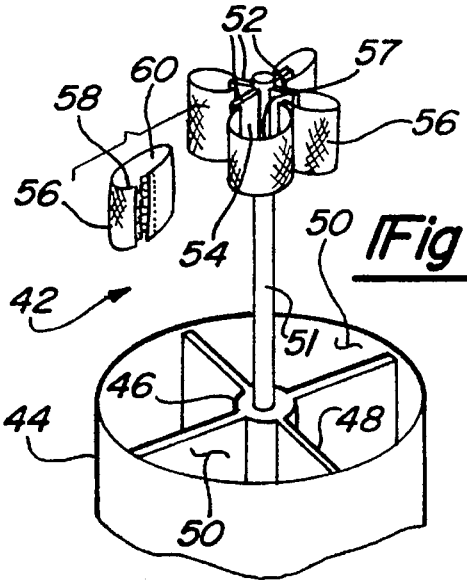
Fig - 5
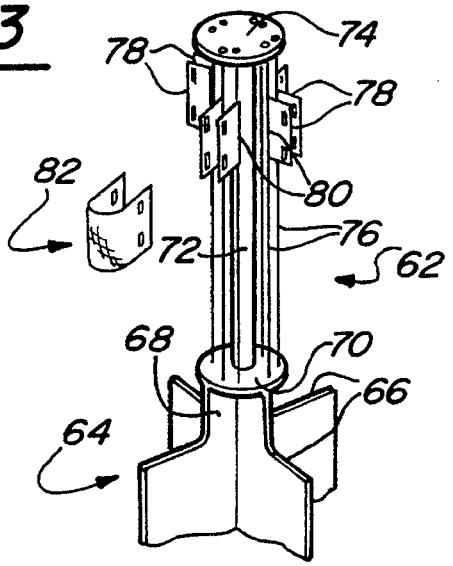
Fig - 6

GOLF CLUB DIVIDER ASSEMBLY FOR USE WITH A GOLF BAG

CROSS REFERENCE TO RELATED APPLICATIONS

The present application is a continuation-in-part of U.S. Ser. No. 08/410,913, filed Mar. 27, 1995, for a golf club divider insert and golf bag and now U.S. Pat. No. 5,505,300.

BACKGROUND OF THE INVENTION

1. Field of the Invention

The present invention relates generally to golf club divider mechanisms and, more particularly, to a golf club divider assembly for use with a golf bag.

2. Description of the Prior Art

The prior art is well documented with many different kinds of golf bag and golf club divider devices. The objective of such devices is usually the same, to conveniently and efficiently arrange the clubs within the bag enclosure to allow for easy retrieval and replacement.

U.S. Pat. No. 3,967,667, issued to Robinson, teaches a golf club cover-holder construction having four tubular plastic members which are secured together in a parallel extending clustered arrangement. The golf club woods are inserted shaft first into the plastic members, with the head portions contacting and spreading outwardly upper leaf portions of each of the members which are separated by vertically extending slotted portions. Referring to the top view of FIG. 5 in Robinson, a single cluster is inserted into the golf bag for holding the woods separate from the remaining golf clubs.

While providing a useful device for protecting the heads of the woods, the device of Robinson is not designed to protect the heads of the irons or putter. It is also evident that the device of Robinson, as shown in cross section, utilizes a fair amount of the available space within the golf bag enclosure making the provision of a number of such devices for holding all of the golfers clubs unlikely.

U.S. Pat. No. 2,752,973, issued to Stamp, teaches a golf club separator which includes a funnel shaped receptor separated into different compartments which is connected to a club shaft receiving sleeve. A rigid post support mounts the receptor and sleeve at an upper end thereof and the post support is inserted into the bag so that the receptor projects a distance above the top rim of the golf bag. Each of the separated compartments in the receptor is filled with a densely packed and cushioned liner for isolating the heads of the woods from the irons and other clubs.

As with Robinson, the device of Stamp requires a fair amount of the space of the golf bag enclosure and further suffers from the drawback that the partition separator is not secured or otherwise mounted within the golf bag which would cause it to move about easily. It is also evident that only a single such partitioner device could be used in a conventionally sized golf bag, thus further limiting its range of use.

SUMMARY OF THE PRESENT INVENTION

The present invention is a golf club divider assembly for protectively securing all of the clubs in an orderly and arranged fashion within a conventional golf bag, the bag having a hollow cylindrical shaped body with a bottom and an open top. The divider assembly includes at least one and preferably a plurality of sleeve shaped subdividing members which are placed within the golf bag. The subdividing members each have a hollow interior into which is inserted an elongated divider member having a plurality of radially extending vane portions. Upon being inserted into the sleeve shaped members, the subdividing members create a plurality of individual golf club shaft receiving cavities.

Preferably, the subdividing members are dimensioned so that they extend a predetermined distance above the top of the sleeve shaped members which are at a level generally coplanar with the open top of the golf bag. Secured to an upper portion of the divider members are one or more shielding portions for individually protecting the heads of each of the golf clubs.

According to a first preferred embodiment, a plurality of elastic covering members are secured to the ends of succeeding vane portions and surround the heads of the golf clubs which are segregated in the various receiving cavities. According to further preferred embodiments, the covering members may be constructed of a flexible cloth material and may be secured to the vanes or between pairs of rigid planar portions which are rotatably mounted to the divider members above the bag enclosure for protecting the heads of longer clubs.

BRIEF DESCRIPTION OF THE DRAWING

Reference will now be made to the attached drawing, when read in combination with the following specification, wherein like reference numerals refer to like parts throughout the several views, and in which:

FIG. 1 is a perspective view in section of the golf club divider assembly for use with a golf bag according to a first preferred embodiment of the present invention;

FIG. 2 is a sectional view of a dividing insert member having elastic club head covering members according to the first preferred embodiment;

FIG. 3 illustrates a plurality of dividing members inserted within respective sleeve shaped members in plan view according to a preferred arrangement;

FIG. 4 illustrates a plurality of dividing members inserted within respective sleeve shaped members in plan view according to a further preferred arrangement;

FIG. 5 is a sectional view of a divider member according to a second preferred embodiment of the present invention;

FIG. 6 is a sectional view of a divider member according to a third preferred embodiment of the present invention.

DESCRIPTION OF THE PREFERRED EMBODIMENTS

Figure 7:
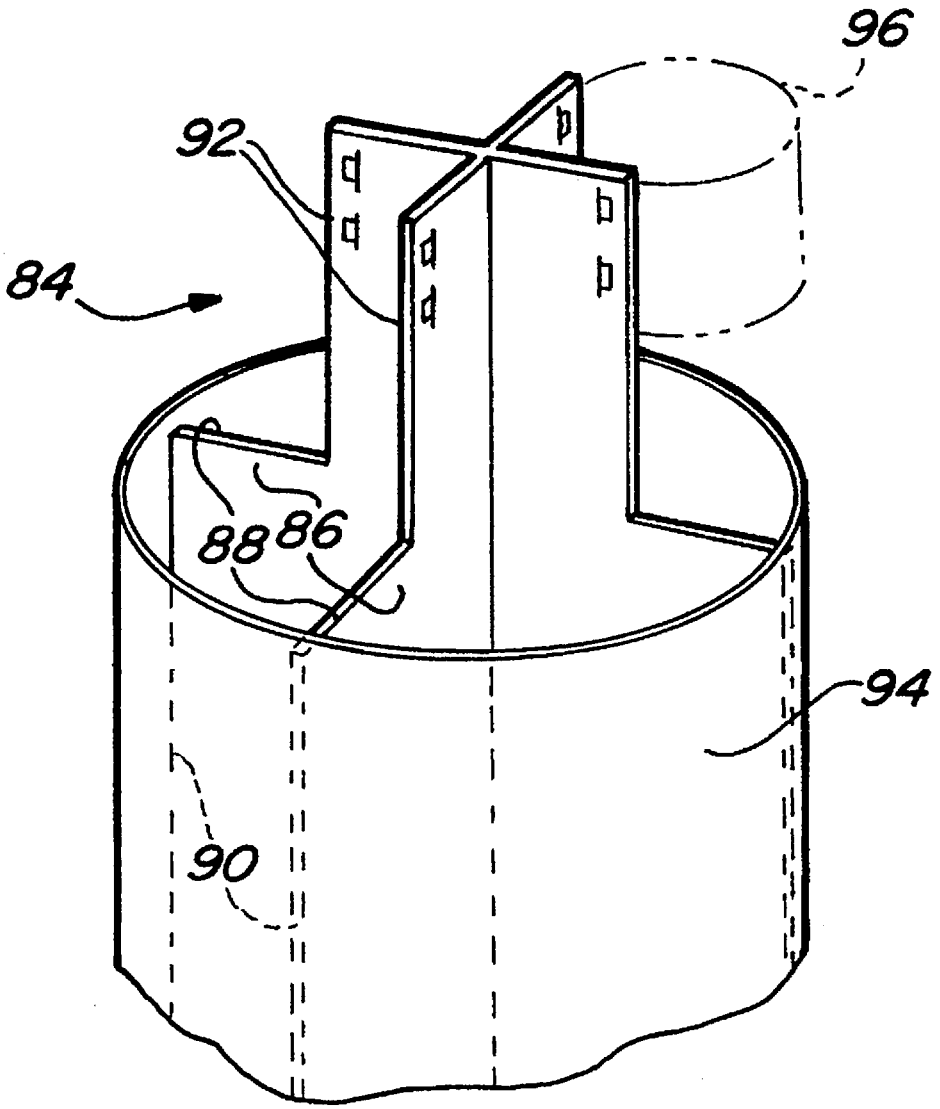
FIG. 7 is the preferred divider assembly embodiment according to the present invention.

Referring now to FIG. 1, a golf club divider assembly 10 for use with a golf bag 12 is shown. The golf bag 12 is only shown in upper section for ease of illustration, however it is of any conventional type known in the art which includes a hollow cylindrical shaped body with a bottom and an open top. The bag may also be constructed of a frame or other skeletal type structure which is covered with a durable cloth or vinyl covering.

Inserted lengthwise into the open bag interior is at least one and preferably a plurality of cylindrical sleeve shaped members. The sleeve shaped members may be of a smaller sized diameter, as indicated at 14. In combination or alternatively, one or more larger sized diameter sleeve shaped members 16 may also be provided. The sleeve shaped members 14 and 16 are preferably constructed of a durable plastic or nylon or lightweight metal such as aluminum and, upon being inserted lengthwise into the golf bag 12, extend the height of the bag with the respective tops of the sleeve shaped members being at a level generally coplanar with the upper bag surface.

Referring again to FIG. 1, a divider member 18 is provided and is constructed of an elongated body member made from any of the above recited materials utilized in the construction of the sleeve shaped members 14 and 16 and which, when viewed in cross section, includes a plurality of radially extending vane portions 20. The vane portions 20 preferably extend the length of the elongated divider member body such that when the divider member is slidably inserted within the sleeve shaped member, in this instance sleeve shaped member 16, it creates a plurality of individual golf club shaft receiving cavities. As is seen from FIG. 1, upon inserting the divider member 18 into the sleeve shaped member 14, a portion of the divider member projects upwardly from the top surface of the golf bag 12. Also, while not shown in FIG. 1, appropriately sized smaller insert dividers may likewise be utilized for segregating golf clubs such as irons which may be placed within the sleeve shaped members 14.

As is shown in the plan view of FIG. 3 according to a first preferred arrangement, a plurality of three sleeve shaped members 16 and divider members 18 are inserted lengthwise within the golf bag 12 enclosure so that pluralities of club shaft receiving cavities 22 are formed within the partitions between the succeeding vane portions 20 as viewed in cross section.

As is further shown in the plan view of FIG. 4 according to a second preferred arrangement, a plurality of four sleeve shaped members 24 are provided with a like plurality of divider members 26. The divider members 26 are partitioned by radially extending vanes 28 into separate pluralities of four club shaft receiving cavities 30 per divider member 26 and sleeve shaped member 24. Accordingly, the embodiment of FIG. 4 would be capable of holding up to sixteen golf clubs and the embodiment of FIG. 3 up to nine golf clubs.

Referring again to FIG. 1, a shielding means is provided for protecting the golf club heads 32 of the clubs which are held within the divider assembly. The shielding means according to the first preferred embodiment is provided by a plurality of covering members 34. The covering members 34 may be constructed either of a flexible cloth or an elastic material and are preferably secured at the outer edges of succeeding vane portions 20 and at the tops of the vane portions. The covering members 34 may be attached by any conventional means known including mating Velcro portions or hooks and fasteners.

Referring to FIG. 2, a divider member 26, such as that shown in the plan view of FIG. 4, detachably mounts a plurality of covering members 36 between the outer edges of succeeding vane portions 28. In this instance, overlapping and selectively detachable means such as Velcro portions 38 and 40 are used at the connection between the edges of the vane portions and the overlapping surfaces of the covering members to mount the covering members in place for shielding the heads of the golf clubs.

Referring now to FIG. 5, a golf club divider assembly 42 is shown according to a further preferred embodiment of the present invention. A sleeve shaped member 44 is provided which is identical in all respects to the sleeve shaped members described in the earlier preferred embodiment. A dividing insert member 46 is constructed of a main body portion having radially extending vane portions 48 and is inserted into the sleeve shaped member 44 to create a plurality of club shaft receiving cavities 50.

A stem portion 51 is attached centrally to the main body portion and extends upwardly along an axis extending longitudinally through a center line in the cylindrical sleeve shaped member 44. The length of the stem portion 51 is dimensioned to correspond to the longest of the golf clubs which may be held within the divider assembly 42. A plurality of planar mounting members 52 extend radially outwardly from an upper periphery of the stem portion 51. Elongated slots 54 may be formed along the lengths of the mounting members 52 at their outer edges and are capable of receiving appropriately configured covering members 56.

In this preferred embodiment, the width of the covering members 56 are inserted through the elongated slots and the ends of the members 56 are secured to one another to create the enclosure for shielding the golf club heads. Alternatively, the covering members may be secured between succeeding mounting members 52 as is shown at 57. The extending ends of the alternate variation 57 of the covering member may be secured to the edges of the vanes by Velcro portions as previously described or by any conventional fashion desired. As was previously described, overlapping Velcro portions may be used to attach the ends of the covering members 56 together, however another preferred way would be to provide a plurality of hook fasteners 58 along one end of the covering member which engages a like plurality of loop type or other receiving portions 60 along the other end. As with the preferred embodiments shown in FIGS. 1–4, a plurality of subdividing inserts and sleeve members may be positioned within a given golf bag enclosure for holding a complete set of clubs. The divider assembly as illustrated in FIG. 5 may preferably be utilized for holding longer clubs such as wood or metal drivers and may be used in combination with one or more of the other divider assemblies as shown in FIGS. 1–4 which can hold the remaining clubs such as irons and or putters.

Referring finally to FIG. 6, a golf club divider member 62 for use within the divider assembly according to a further preferred embodiment is shown in upper sectional cutaway. The divider member 62 includes a main body portion 64 having a plurality of radially extending vane portions 66. The vane portions 66 are inwardly stepped at upper ends thereof and narrow to a reduced dimensioned neck portion 68. Mounted atop the neck portion 68 is a first planar support portion 70 and extending upwardly from the support portion 70 for a predetermined height is a central stem portion 72.

A second planar support portion 74 is mounted to an upper end of the central stem portion 72. Secured between the first and second support portions 70 and 74 are pairs of thin rigid cords 76 which are located along the outer circumferential peripheries of the support portions and which are segregated to upper areas corresponding to the club shaft cavity portions defined within the dividing member main body portion 64. In a preferred embodiment, the pairs of cords 76 may originate as flexible elongated pieces of line which are attached to the first and second support portions and which are drawn taut between the support portions when mounted in place. The pairs of cords 76 extend parallel to the central stem portion 72 and are preferably of an equal number to the number of club shaft enclosures.

Pairs of rigid planar portions 78 are provided and are constructed so that they may be rotatably mounted to the respective pairs of cords 76. Each of the rigid portions 78 includes a base edge surface 80 which may have an internally hollowed channel (not shown) extending its length for slidably receiving an associated cord 76. The pairs of rigid portions 78 may further be mounted to their associated pairs of cords 76 in a slight friction fit manner so that the portions 78 may be translatably moved between upper and lower positions along the vertical lengths of the cords.

Once the divider member 64 is mounted within a sleeve shaped member (not shown) within a golf bag, one or more golf clubs (also not shown) may be axially inserted within their associated elongated receiving cavities. The heads of the longer golf clubs such as the drivers will likely project a distance above the golf bag and main body portion 64 of the divider member. Each of the pairs of the rigid planar portions 78 are then vertically translated by frictionally moving them along the cords 76 to the appropriate position of the club head and they are then rotated to encircle the club head therebetween.

One or more covering members 82 may again be attached to the ends of the pairs of rigid planar portions 78 through a hook and slot or other type arrangement and provide the added feature of isolating and shielding the club head from other associated clubs. A divider member 64 such as is taught by this embodiment may be used in a similar fashion to that shown in FIG. 5 for protecting longer golf clubs in association with other variations of the divider assemblies or alternatively a plurality of dividers according to the embodiment 64 may be used.

Referring to FIG. 7 the most preferred embodiment 84 of the divider assembly is shown. According to this embodiment divider members 86 are inwardly stepped by surfaces 88 from first outer edges 90 to second inner edges 92 so that the diameter of the divider in cross section is reduced. The divider inserts in a cylindrical sleeve member 94 as is shown in the prior embodiments. Covering members 96 may also be attached between the veins of the divider members to shield the golf club heads and the reduced diameter portions of the dividers provide adequate support for the golf clubs.

Having described my invention, it is therefore apparent that the present invention teaches a novel and useful divider assembly for golf clubs for conveniently and effectively segregating and positioning any plurality of golf clubs of any size for quick retrieval and replacement. The present invention furthermore provides an effective assembly for use with any conventional golf bag for effectively protecting the heads and shafts of the golf clubs in a manner not suggested by the prior art.

Further embodiments will become apparent to one skilled in the art to which the present invention pertains upon reference to the appended claims.

I claim:

1. A golf club divider assembly for use with a golf bag, the golf bag having a hollow cylindrical shaped body with a bottom and an open top, said divider assembly comprising:

at least one sleeve shaped member placed within the golf bag;

at least one elongated divider member having a plurality of radially projecting and axially extending vane portions, said divider member being arranged within said at least one sleeve shaped member to create a plurality of individual golf club shaft receiving cavities lengthwise within an enclosure of the golf bag; and shielding means secured about an upper portion of said at least one divider member for individually protecting each of a plurality of golf club heads projecting above said at least one divider member.

2. The golf club divider assembly for use with a golf bag as described in claim 1, said at least one elongated divider member being slidably inserted lengthwise into said at least one sleeve shaped member.

3. The golf club divider assembly for use with a golf bag as described in claim 1, said upper portion of said at least one divider member extending above the open top of the golf bag.

4. The golf club divider assembly for use with a golf bag as described in claim 3, said upper portion of said at least one divider member further comprising an upwardly extending stem portion.

5. The golf club divider assembly for use with a golf bag as described in claim 4, a plurality of planar shaped mounting members extending radially outwardly from an upper area of said stem portion, each of said shielding means being slidably engaged through a channel formed lengthwise along an outer edge of said planar mounting members.

6. The golf club divider assembly for use with a golf bag as described in claim 4, further comprising a first planar support portion mounted to a lower end of said upwardly extending stem portion and a second planar support portion mounted atop an upper end of said stem portion.

7. The golf club divider assembly for use with a golf bag as described in claim 6, further comprising a plurality of pairs of thin rigid cord members extending between said first and second planar support portions, said pairs of cord members being positioned in proximately to an outer circumference of said support portions and being segregated to positions which are in alignment with the positioning of said club shaft receiving cavities.

8. The golf club divider assembly for use with a golf bag as described in claim 7, further comprising a plurality of pairs of rigid planar members and means for rotatably and frictionally slidably mounting said planar members to said pairs of thin rigid cord members.

9. The golf club divider assembly for use with a golf bag as described in claim 8, said means for rotatably and frictionally slidably mounting further comprising at least one internally channeled member formed within an inner edge of each of said rigid planar members through which is slidably and frictionally engaged said associated rigid cord member.

10. The golf club divider assembly for use with a golf bag as described in claim 1, further comprising a plurality of elongated divider members and a like plurality of sleeve shaped members arranged axially in a bundled arrangement within the golf bag interior.

11. The golf club divider assembly for use with a golf bag as described in claim 1, said shielding means further comprising a plurality of covering members, each of said covering members being attached to and extending between said axially extending and succeeding vane portions and forming a surrounding enclosure therebetween for shielding the associated golf club head.

12. The golf club divider assembly for use with a golf bag as described in claim 11, said covering members each further including overlapping Velcro fasteners for attaching said covering members.

13. The golf club divider assembly for use with a golf bag as described in claim 11, said covering members each further including hook and loop fasteners for attaching said covering members.

14. The golf club divider assembly for use with a golf bag as described in claim 11, said covering members each being constructed of an elastic material.

15. The golf club divider assembly for use with a golf bag as described in claim 11, said covering members each being constructed of a flexible cloth material.

16. The golf club divider assembly for use with a golf bag as described in claim 1, said at least one sleeve shaped member and said at least one divider member being constructed of a durable plastic material.

17. The golf club divider assembly fur use with a golf bag as described in claim 1, said at least one sleeve shaped member and said at least one divider member being constructed of a lightweight metal material.

* * * * *